US006526637B1

(12) United States Patent
Geissler

(10) Patent No.: US 6,526,637 B1
(45) Date of Patent: Mar. 4, 2003

(54) DEVICE FOR CONTINUOUS PRODUCTION OF FOIL EXPANDED METAL

(75) Inventor: Norbert Geissler, Gauting (DE)

(73) Assignee: Michael Spaeth (DE)

( * ) Notice: Subject to any disclaimer, the term of this patent is extended or adjusted under 35 U.S.C. 154(b) by 0 days.

(21) Appl. No.: 09/423,809

(22) PCT Filed: May 12, 1998

(86) PCT No.: PCT/EP98/02774

§ 371 (c)(1),
(2), (4) Date: Nov. 16, 2000

(87) PCT Pub. No.: WO98/51429

PCT Pub. Date: Nov. 19, 1998

(30) Foreign Application Priority Data

May 14, 1997 (DE) ..... 197 20 229

(51) Int. Cl.[7] ..... B21D 31/04
(52) U.S. Cl. ..... 29/6.1
(58) Field of Search ..... 29/2, 6.1, 6.2, 29/623.1, 730, 731

(56) References Cited

U.S. PATENT DOCUMENTS 4,144,624 A 3/1979 Szego et al.
4,291,443 A 9/1981 Laurie et al.
4,315,356 A * 2/1982 Laurie et al. ..... 29/6.1
4,621,397 A 11/1986 Schrenk
4,921,118 A * 5/1990 Gass ..... 220/88.1
5,088,170 A * 2/1992 Spath ..... 29/6.1
5,093,971 A * 3/1992 Hein ..... 29/6.1
5,136,765 A * 8/1992 Tanaka et al. ..... 29/6.1
5,239,735 A * 8/1993 Tanaka et al. ..... 29/6.1
5,781,976 A * 7/1998 Stuhlbacher et al. ..... 29/6.1
5,896,635 A * 4/1999 Marlow et al. ..... 29/6.1
6,212,744 B1 * 4/2001 Inanobe et al. ..... 29/6.1

FOREIGN PATENT DOCUMENTS

DE 38 14 448 A 11/1989

* cited by examiner

*Primary Examiner*—S. Thomas Hughes
*Assistant Examiner*—Essama Omgba
(74) *Attorney, Agent, or Firm*—Conley, Rose & Tayon

(57) ABSTRACT

A device for continuous production of foil expanded metal comprising a cutting unit for continuous production of parallel, staggered longitudinal cuts in the foil, and an expansion unit for expanding the foil with the cuts perpendicularly to the longitudinal direction of the foil, the expansion unit provided with toothed belts which grasp both edges of the foil, in addition to a running body which is arranged therebetween to expand the foil running thereon. The configuration of the device is such that a toothed belt and a toothed wheel interacting therewith at a given angle are assigned to each foil edge, the edge of the foil is grasped between the toothed belt and the toothed wheel within an input and an output point. The toothed wheels are inclined in relation to each other so that their distance perpendicular to the longitudinal direction of the foil increases at the contact angle in the longitudinal direction of the foil.

16 Claims, 3 Drawing Sheets

DEVICE FOR CONTINUOUS PRODUCTION OF FOIL EXPANDED METAL

This application is the national phase under 35 U.S.C. §371 of PCT International Application No. PCT/EP98/02774 which has an International filing date of May 12, 1998, which designated the United States of America.

The invention relates to a device for continuous production of expanded metal from metal foil.

Such a device is known from German patent document DE-38 14 448. In this device, an expansion unit comprises two pairs of toothed belts which grip both edges of a foil, and transport it longitudinally. A feed-surface body is arranged between the toothed belts in the form of a driven belt whose velocity is greater than or equal to the velocity of the winding foil.

Problems are associated with this unit with regard to obtainable quality, production speed, and energy consumption. Sufficient pressure and, consequently, sufficient traction cannot be placed on that stretch of the foil edges which is gripped by the two toothed belts so that during spreading by the feed-surface body, one edge or both edges can detach from the toothed belts. In addition, a spreading effect of the feed-surface body may be insufficient. This results in limitations in quality and production speed. Furthermore, overall friction forces which occur are substantial, resulting in significant energy requirements.

It is an object of this invention to improve the device of the type set forth above with regard to quality, production speed, and energy requirements.

This object is achieved according to this invention by the features set forth herein. Suitable enhancements of the invention are also set forth. A proposed embodiment makes possible a holding of a respective foil edge with required pressure between each toothed gear and a corresponding toothed belt in a region of a belt-wrap angle. This pressure can be adjusted in an uncomplicated manner. The feed-surface body advantageously is of several idling spread rollers arranged within the belt-wrap angle between the foil edges behind an entry point of the foil into the expansion unit. Using an expansion unit of the above type can reduce overall energy requirements to one-third.

The invention is described below using the examples of FIGS. 1–3. Shown are:

Figure 1:
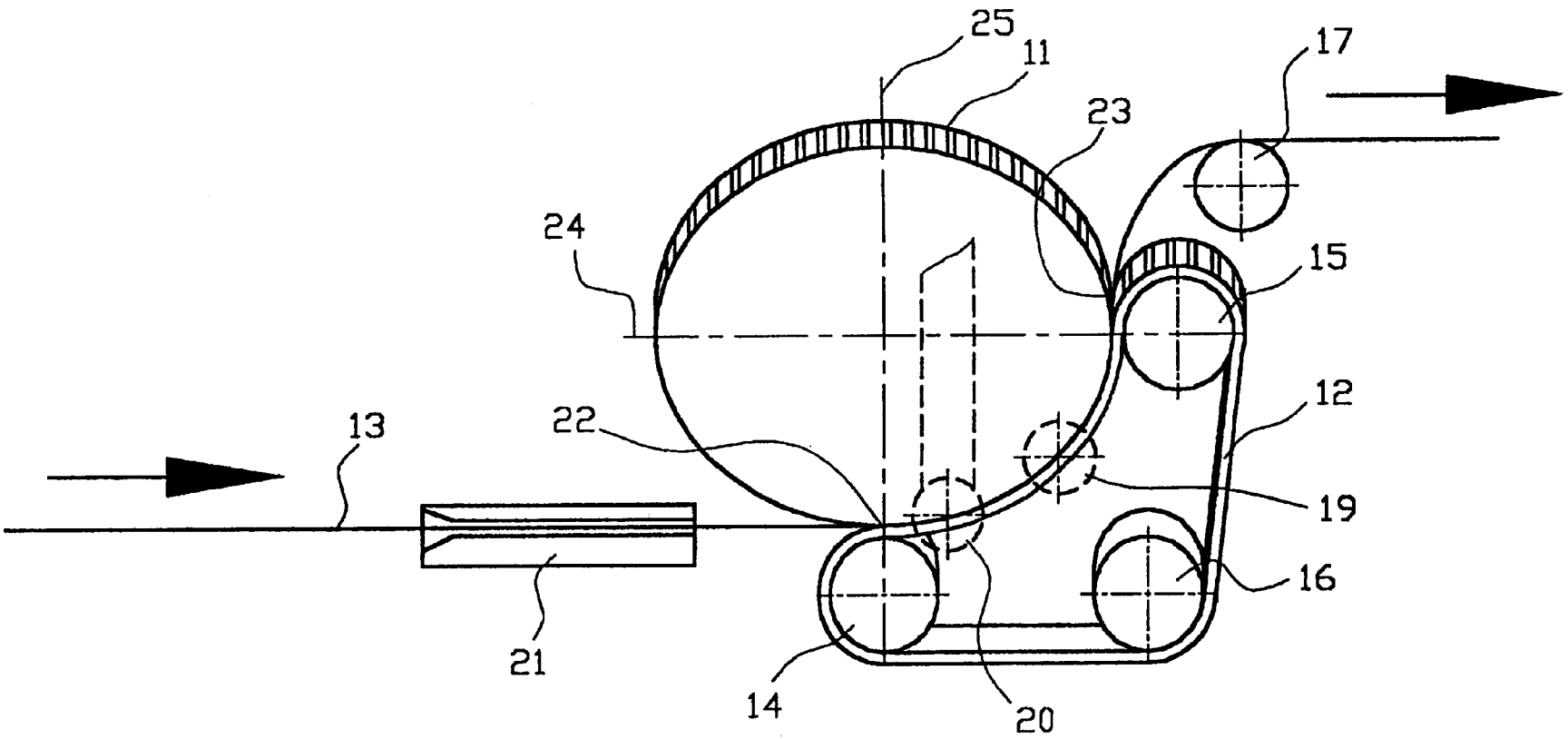
FIG. 1 is a schematic side view of an expansion unit.

A foil 13, provided with appropriate slits in a cutting unit, is fed, as shown in FIG. 1, via a guide 21 to an expansion unit, which includes a toothed gear 11 and a toothed belt 12 for each foil edge.

Hereafter only a part of the expansion unit corresponding to one foil edge is described. The foil enters, via the guide 21, at an entry point 22 into the expansion unit, and leaves it again at an exit point 23. In a region between the entry and exit points 22, 23, the foil 13 is gripped by the toothed gear 11 and the toothed belt 12. The endless toothed belt 12 runs over guide rollers 14, 15, and 16, of which the guide roller 14 is arranged at the entry point 22 and the guide roller 15 is arranged at the exit point 23, so that there is a belt-wrap angle of approximately 90° between the entry point 22 and the exit point 23. Rotational axes of the guide rollers 14, 15, and 16 and of the toothed gear 11 extend parallel, and lateral axes of the guide rollers are aligned with lateral axes 24 and 25 of the toothed gear 11.

Figure 2:
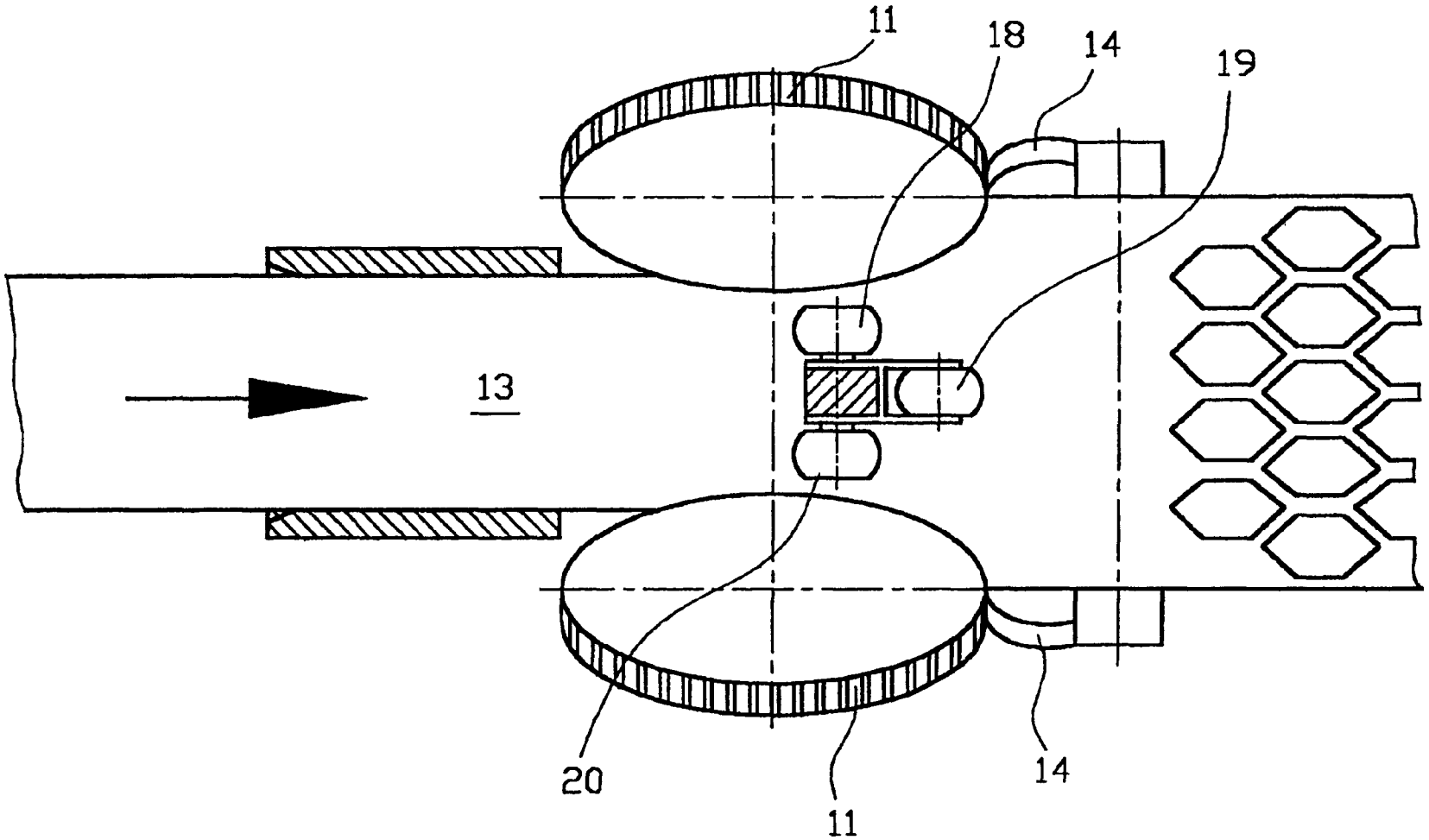
FIG. 2 is a schematic top view of the expansion unit.

Expansion of the foil 13 in a transverse direction is accomplished in that the lateral axis 25 of the toothed gear 11, which extends through the entry point 22 of the foil 13, is outwardly inclined relative to the foil 13, as shown in FIG. 2.

Because of this, a spacing between oppositely positioned toothed gears 11 and corresponding toothed belts 12 within the belt-wrap angle between the entry and exit points 22, 23 is increased along the travel direction of the foil 13, so that a required expansion is achieved.

The guide roller 15 can be vertically adjusted, and the guide roller 16 can be correspondingly horizontally adjusted, to accommodate different foil widths. Also, spacing between the toothed gears 11 and the toothed belts 12, as well as the respective guide rollers 14 through 16, can be adjusted.

Figure 3:
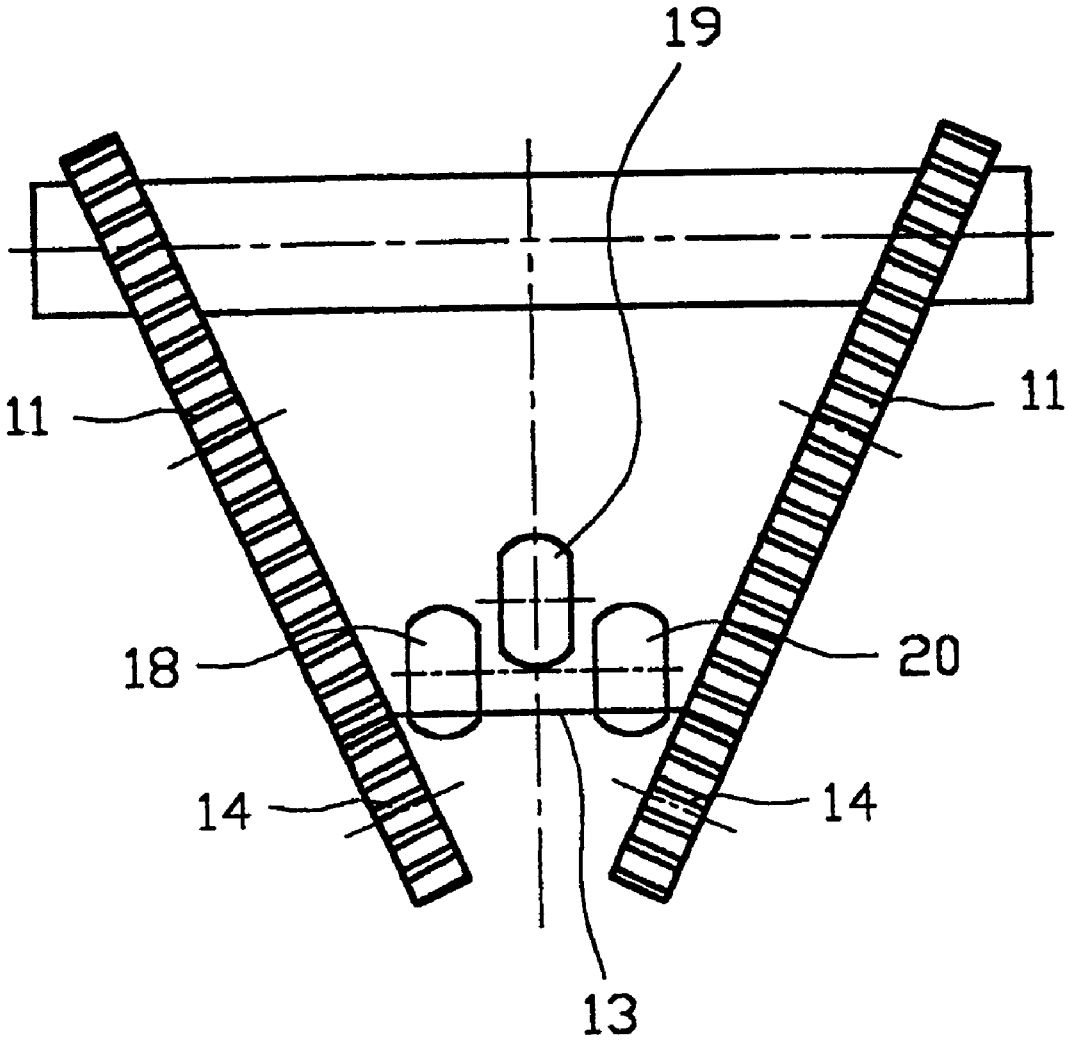
FIG. 3 is a schematic front view of the expansion unit.

The front view of the expansion unit in FIG. 3 also shows how the toothed gears 11 are outwardly inclined.

A further, not-shown, possibility is to rotate the toothed gears 11 outwardly about their lateral axes 25 extending through the entry point 22, in the foil travel direction. The two embodiments may also be combined.

In order to also stretch the foil 13 of the wrap region (in the middle region), a feed-surface body, which suitably includes at least one idling spread roller having a convex curved feeding surface, it arranged between the toothed gears 11. Three spread rollers 18, 19, and 20 are provided in the preferred embodiment as shown in FIG. 3, of which the two spread rollers 18 and 20 are arranged on a common axis just behind the entry points 22, and the spread roller 19 is arranged behind these rollers. As particularly shown in FIG. 1, the spread rollers engage to positions below the toothed belts 12 in the region of the belt-wrap angle, so that the foil 13 is bulged outwardly in a convex shape.

Following the exit point 23, the foil 13 travels via a guide roller 17 to a downstream processing station.

One of the guide rollers 14, 15 can be suitably driven. In this case, the guide roller can have toothing, and the toothed belt 12 can have corresponding toothing on its underside.

Furthermore, it is advantageous for the toothed gears 11 to turn synchronously and be aligned relative to tooth spacings.

What is claimed is:

1. A device for continuous production of expanded metal from foil with a cutting unit for continuous creation of parallel, staggered cuts in a longitudinal direction of the foil, and with an expansion unit for expanding the cut foil in a direction generally transverse to the longitudinal direction of the foil, said device having toothed belts to grip both edges of the foil and a feed-surface body arranged between the toothed belts to spread the foil traveling thereon, characterized in that a toothed belt (12) and a toothed gear (11) cooperating over a specified belt-wrap angle are arranged at each foil edge, between which the foil edge is gripped between an entry point (22) and an exit point (23), and the toothed gear (11) at one foil edge is inclined relative to the toothed gear at the other foil edge so that their spacing, generally transverse to the longitudinal direction of the foil, increases over the belt-wrap angle in the longitudinal direction of the foil.

2. The device of claim 1, characterized in that a transverse axis (25), which runs through the entry point (22) of the foil (13), of the tooth gear (11) is outwardly inclined relative to the foil (13).

3. The device of claim 1, characterized in that the toothed gears are rotated about their transverse axis, which runs through the entry point.

4. The device as in claim 1, characterized in that a respective toothed belt guide roller (14, 15) is arranged at each of the entry and exit points (22, 23) of the foil (13).

5. The device of claim 4, characterized in that the toothed belts (12) are structured to be endless.

6. The device of claim 4, characterized in that an additional toothed belt guide roller (16) is provided.

7. The device of claim 6, characterized in that the guide roller (15), at the exit point (23), can be vertically adjusted, and the additional guide roller (16) can be horizontally adjusted.

8. The device of claim 4, characterized in that the rotational axes of the toothed gear (11) and of the guide rollers (14, 15, 16) are parallel.

9. The device of claim 1, characterized in that the feed-surface body comprises at least one idling spread roller with a feed surface that is curved, which is arranged near the entry point (22).

10. The device of claim 1, characterized in that the feed-surface body comprises two idling spread rollers (18, 20) on a common axis near the entry point (22), and a downstream idling spread roller (19) having a curved feed surface.

11. The device of claim 1, characterized in that the belt-wrap angle is approximately 90°.

12. The device of claim 1, characterized in that a distance between the toothed gears (11) and toothed belts (12) is adjustable in a transverse direction of the foil (13).

13. The device of claim 1, characterized in that a foil guide roller (17) is arranged downstream of the exit point (23), in a foil-travel direction.

14. The device of claim 1, characterized in that the toothed gears (11) are rotated synchronously and in alignment with tooth spacings.

15. The device of claim 4, characterized in that one of the toothed guide rollers (14, 15) at the a respective entry and exit point (22, 23) is driven, and has toothing which acts together with corresponding toothing on an underside of the toothed belt.

16. The device of claim 1, characterized in that the foil is aluminum foil.

* * * * *